US005992203A

United States Patent [19]

Chubb et al.

[11] Patent Number: 5,992,203

[45] Date of Patent: Nov. 30, 1999

[54] COIL HOLDER FOR A SHEET BENDING BRAKE

[75] Inventors: Arthur B. Chubb, Romulus; Matthew S. Damron, Dearborn Heights; James E. Suyak, Lincoln Park, all of Mich.

[73] Assignee: Tapco International Corporation, Plymouth, Mich.

[21] Appl. No.: 09/005,275

[22] Filed: Jan. 9, 1998

Related U.S. Application Data

[62] Division of application No. 08/611,936, Mar. 6, 1996, Pat. No. 5,706,692.

[51] Int. Cl.[6] ..... B65H 16/08; B21D 5/04

[52] U.S. Cl. ..... 72/319; 242/419.4; 242/422.5; 242/599.4

[58] Field of Search ..... 72/319, 183, 294; 242/419.4, 402, 422.5, 599.4, 595.1, 547, 597.6, 598.3, 598

[56] References Cited

U.S. PATENT DOCUMENTS

| | | | |
|---|---|---|---|
| 1,416,882 | 5/1922 | Sandals | 242/598.6 |
| 1,445,022 | 2/1923 | Kimball | 242/419.4 |
| 4,246,817 | 1/1981 | Marsh | 83/455 |
| 4,291,845 | 9/1981 | Van Cleave | 242/595.1 |
| 4,364,254 | 12/1982 | Chubb | 72/319 |
| 4,592,518 | 6/1986 | Chubb | 242/595.1 |
| 4,682,741 | 7/1987 | Honegger | 242/421.3 |
| 4,705,227 | 11/1987 | Honnegger | 242/528 |
| 4,898,336 | 2/1990 | Reist | 242/528 |
| 5,582,053 | 12/1996 | Chubb | 72/294 |
| 5,673,869 | 10/1997 | Honegger | 242/533 |

FOREIGN PATENT DOCUMENTS

| | | | |
|---|---|---|---|
| 1467883 | 2/1967 | France | 242/419.4 |
| 2504429 | 10/1982 | France | 72/332 |

*Primary Examiner*—Daniel C. Crane
*Attorney, Agent, or Firm*—Howard & Howard

[57] ABSTRACT

A combined sheet bending brake, coil holder and cut-off mechanism that includes a sheet bending brake having a support base, and elongated fixed and movable clamping members carried by the support base so as to clamp sheet stock extending longitudinally between the clamping members. A coil holder has a support frame removably cantilevered from one end of the support base. A trolley is removably mounted on the support frame, and has a pair of spaced rollers that extend axially in a direction transverse to the elongated fixed and movable clamping members on the brake for extending through and rotatably supporting a coil of sheet stock. Bars are carried by said support frame for releasably clamping a stock end extending from a coil on the trolley. A cut-off mechanism is removably mountable on the coil holder for severing sheet end stock extending from the holder into said bending brake. The coil holder has structure for guidingly supporting the cut-off mechanism for controlled severing of end stock clamped by said clamping bars.

10 Claims, 6 Drawing Sheets

COIL HOLDER FOR A SHEET BENDING BRAKE

This is a divisional of application Ser. No. 08/611,936 filed on Mar. 6, 1996, now U.S. Pat. No. 5,706,692.

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,481,174, 3,482,427, 3,559,444, 3,817,075, 3,872,755, 4,321,817 and 4,557,132. Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. No. 3,161,223, the tendency to mar the surface of the sheet material was minimized by having the intermeshing integral projections between the fixed member and the bending member, which extend longitudinally and define the hinge that connects the bending member with the fixed member having the clamping surface, positioned so that all portions of the projections do not extend above the plane of the surface of the members when the surfaces are substantially aligned. U.S. Pat. Nos. 3,481,174 and 3,482,427 were directed to an arrangement which included a floatable compensator on the bending member which engages the sheet material and, as the bending member is swung to bend the sheet, pivots so that the contact with the sheet material is maintained.

In U.S. Pat. No. 4,557,132, there is disclosed and claimed a sheet bending brake that incorporates a novel construction for minimizing the marring of the surface of the sheet material during bending; which functions without the need for added parts; which can be manufactured at low cost; which can be adapted to sheet material of various thicknesses; and which can be utilized in a novel fashion to provide a complete 180° bend to the sheet material. As described in this patent, each of the fixed and movable bending members has substantially the entire length of the longitudinal edges thereof formed with longitudinally spaced intermeshing integral projections. The projections on the bending member have a plurality of aligned openings, and the projections on the fixed member have a plurality of aligned openings comprising slots extending axially with respect to the longitudinal axis of such member. A hinge pin extends through the openings of the bending member and the slots of the fixed member. The slots have a configuration such that, as the bending member is moved relative to the fixed member to bend a workpiece, the hinge pin is guided along the slots such that the contacting portion of the bending member remains substantially in the same position relative to the workpiece.

In U.S. Pat. No. 4,364,254, there is disclosed a table mounted on the sheet bending brake and extending horizontally and rearwardly from the clamping surface of the sheet bending brake. A coil stand is mounted on the end of the sheet bending brake such that the axis of the roll of sheet stock extends transversely of the longitudinal axis of the sheet bending brake so that a length of sheet material can be unrolled from the coil stand onto the table, severed from the remainder of the uncoiled stock in the coil stand and then manually transferred from the table to the sheet bending brake for bending.

Among the objectives of the present invention are to provide a combined sheet bending brake, coil support and cutter, and a method of use, which permit the leading edge of the workpiece to pass directly from the coil between the clamping member and the fixed member; which provide a portable bending brake coil support and a hand-operated cutter system that is removably mounted on the coil support; which will accurately cut the workpiece to a desired length; which require minimal modification of the portable sheet bending brake; which can be readily added to an existing portable sheet bending brake; which will provide accurate, smooth and flat edges on the workpiece; which cut the workpiece quickly and is therefore time saving; which do not damage the aluminum parts of the portable sheet bending brake; and which are low in cost; wherein the coil support has a detachable trolley member for insertion through the coil opening thereby facilitating the elevation of the coil to the bending brake; wherein the detachable trolley member with a separate base member allows the rotational dispensation of the coil stock from any flat surface; and wherein the support coil apparatus has a movable clamping track portion for allowing unobstructed passage of the coil stock material through and into the sheet bending brake to a predetermined point at which the clamping track is closed to clamp the coil such that subsequently a hand operated cutter is extendable along a track on the clamp to sever the extended end from the coil.

In accordance with the invention, a workpiece coil support is adapted for attachment to a sheet bending brake and comprises a main frame on one end of the brake. Coil trolley receiving rails support the trolley and coil and maintain the orientation of the dispensed material to the brake. A movable clamping member is attached and includes a track. The clamping member is associated with a fixed clamp surface. The coil trolley comprises opposing end supports attached by a cross-member. Situated on either side of the cross-member, and mounted on the ends of the supports, are rollers which allow the free-rotation of the coil.

In practice, the trolley is inserted through a coil so that it can be lifted with its leading edge facing toward sheet bending brake. The trolley is slid onto the receiving rails and fixed with a hitch pin. The leading edge of the coil is advanced between the fixed and movable clamping surfaces, and onto and through the opened clamping member of the sheet bending brake so that a portion of the coil rests on the fixed clamping member of the sheet bending brake to a desired length. The movable clamp of the coil support is locked to the fixed clamp holding the material therebetween. A hand-removable and hand-operable sheet cutter is then fitted to the track and extended therealong severing the material from the coil. The severed material provides a workpiece, which is then repositioned in the sheet bending brake and clamped. To prevent the coil from unwinding, a pinch roller is placed between opposing control forks mounted on the receiving rails. Spring biasing retainers are then fitted over the axles extending from the ends of the roller. The downward pull of the springs against the axles cause biasing contact between the roller and the top surface of the coil, causing a drag on the rotation of the coil.

Another embodiment of the present invention comprises a free-standing base member adapted for receiving the trolley as above described. The base comprises horizontally extending rails oppositely fixed by cross-members. Centrally extending upward from the base frame rails are support masts which terminate with receiving trolley supports. As with the main embodiment of the present invention, the trolley is inserted through the coil opening elevating, and sliding onto, the receiving supports. Control forks extend upward from the receiver supports to a point consistent with communicating with the axles of a pinch roller used to prevent the unraveling of the coil. Further, a fixed clamp bar is attached to the base rails and adapted for communication with a movable clamp bar attached to locking clamp members mounted also to the base rails. The leading edge of the coil is fed between the clamping surfaces, which are then locked. A utility hand knife is then used to score the material using the clamping bar as a guide. The material is then flexed at the score effecting the sever of the material. To prevent damage to the clamping bar, as well as the movable track of the main embodiment, due to shaving from the utility knife blade, a stainless steel strip is fitted to the edge of the clamping bar.

DESCRIPTION OF THE PREFERRED EMBODIMENTS

Figure 11:
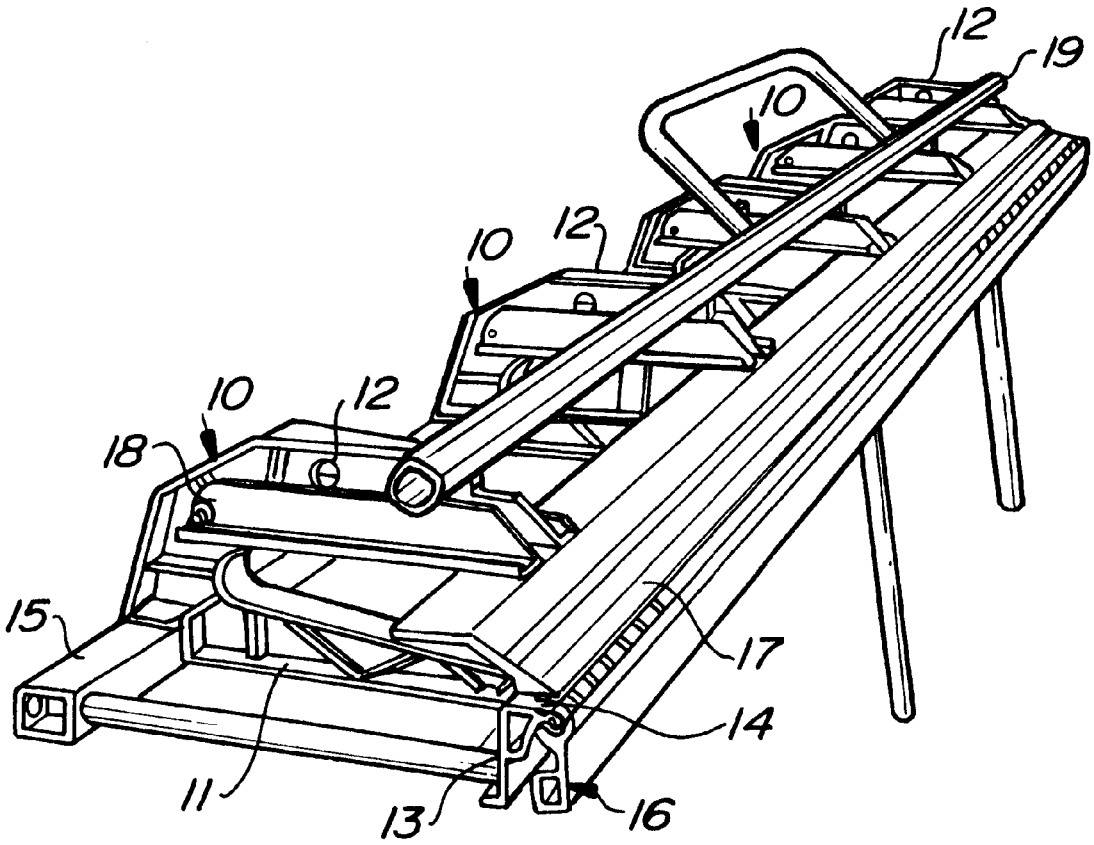
FIG. 11 is a perspective view of a sheet bending brake in connection with which the invention is employed in its preferred implementation.
Figure 12:
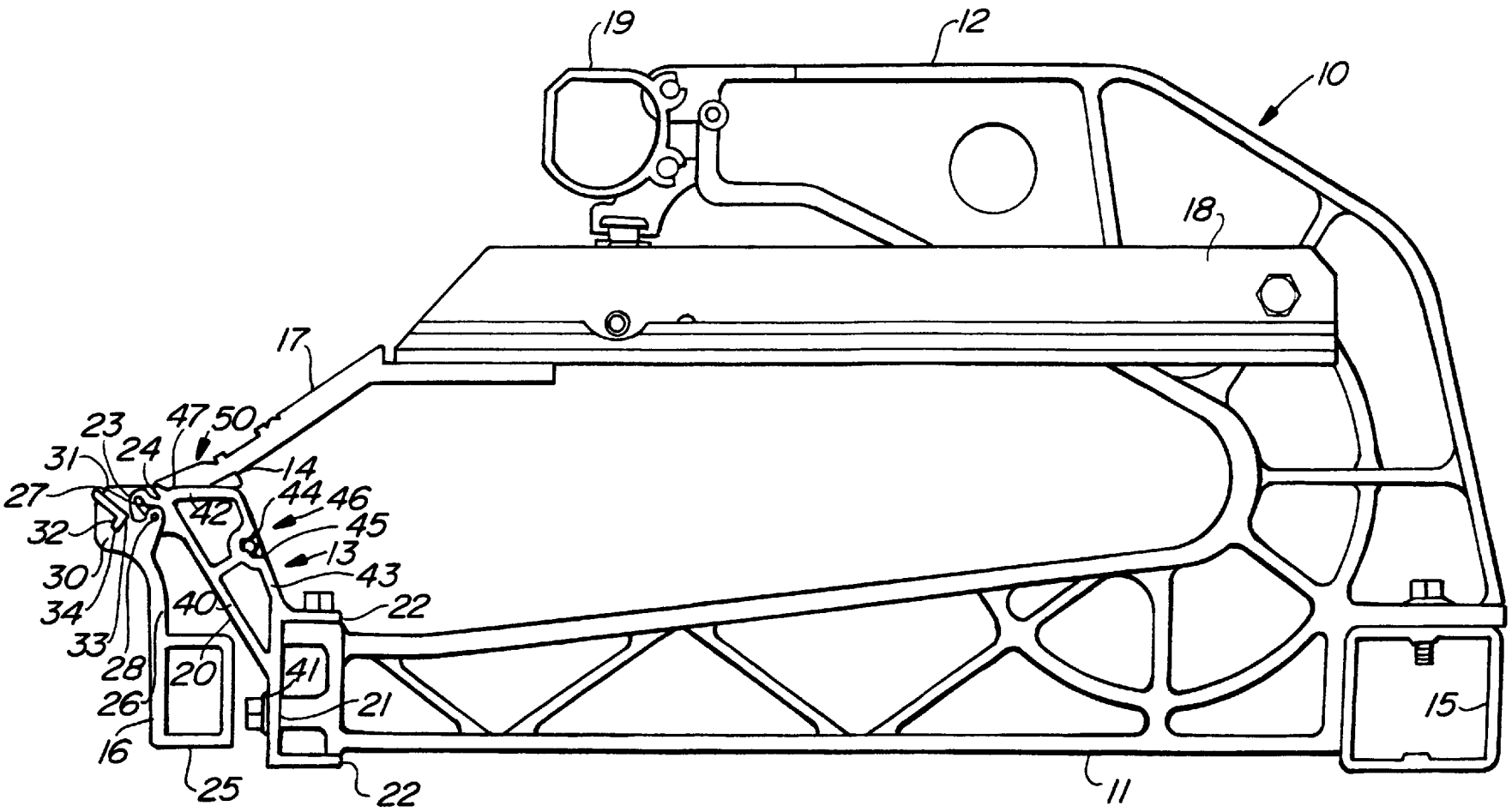
FIG. 12 is an end elevational view of the sheet bending brake of FIG. 11.

Referring to FIGS. 11 and 12, a sheet bending brake to which the invention may be applied comprises longitudinally spaced C-shaped frame members 10. Each frame member 10 includes a lower arm 11, and an upper arm 12 which overlies the lower arm 11 in spaced relation thereto. Legs may be provided as needed to support the brake above the floor or working area. A first extruded fixed member 13 is fixed on the ends of the free lower arms 11 and defines a clamping surface 14. Longitudinally spaced base rails 15 are fixed to the rear ends of the lower arms 11. A second extruded bending member 16 is hinged to the first member 13, as presently described, to provide a means for bending the sheet material.

A clamping member 17 extends longitudinally in overlying relationship to the clamping surface 14 of the first member 13. Means are provided for moving clamping member 17 toward and away from clamping surface 14 to clamp a workpiece on the clamping surface. The means for clamping the workpiece may comprise any of the structures set forth in the aforementioned United States Patents, incorporated herein by reference, but as herein shown comprise channel-shaped pivot bars 18 pivoted on each frame member 10 with clamping member 17 fixed thereto, and a handle member 19 pivoted to the upper arm 12 of each C-frame member 10. Handle member 19 is coupled to pivot bars 18 by a plurality of extensible links pivoted at an upper edge to the handle member 19 and at a lower end to pivot bars 18. The extensible links may be of the type shown in U.S. Pat. No. 4,766,757, incorporated herein by reference, or copending U.S. patent application Ser. No. 08/111,978 filed Aug. 25, 1993, now U.S. Pat. No. 5,353,620, also incorporated herein by reference.

The first member 13 having the clamping surface 14 is formed as an aluminum extrusion, and includes an upper tubular portion 20 and a lower portion 21 having spaced flanges 22 engaging the free ends of lower arms 11. A plurality of longitudinally spaced projections 23 are provided at the juncture of the portion 20 which defines the clamping surface 14. Each projection 23 has a slot 24 formed therein, and the slots 24 of the various projections 23 are in longitudinal alignment. Each slot 24 has its lower end spaced from the clamping surface, and each slot extends outwardly and upwardly so that is upper end is generally near the plane of the clamping surface. Each slot 24 is preferably arcuate, has a center spaced from the clamping surface and preferably extends for substantially 90°.

The bending member 16 is also in the form of an aluminum extrusion, including a tubular portion 25 and a longitudinally extending leg 26 with a plurality of longitudinally spaced projections 27 having openings 28 therein. The projections 27 of the bending member 16 mesh with the projections 23 of the fixed member 13, and a pin 29 extends through the openings 28 and slots 24 to hinge bending member 16 to fixed member 13. The bending member 16 further includes a portion 30 that extends upwardly and outwardly when bending member 16 is in position for bending, and has a contacting portion defined by a longitudinally extending plastic strip 31 positioned in a recess 32. Recess 32 is generally L-shaped, and strip 31 includes a short leg 33 having an enlarged end portion 34 for holding strip 31. The other leg of strip 31 extends along recess 32 beyond portion 34 to define a sheet contacting portion. Strip 31 is preferably made of polyurethane having a durometer of 60 on the A scale. The fixed member 13 further includes a recess extending longitudinally at the juncture of the clamping surface 14 and the projections 23. This recess functions as a pocket into which any burrs may fall from a knife used for scoring the workpiece. Clamping surface 14 is spaced slightly above projections 23 in order to minimize marring of the surface of the workpiece when it is inserted and removed. Bending member 16 also includes a recess extending longitudinally between projections 27 and contacting portion 31.

In use, a workpiece of sheet material is clamped against clamping surface 14, and bending member 16 is moved by manually swinging tubular portion 25 upwardly and outwardly bringing strip 31 of the bending member 16 into engagement with the sheet material. As the bending member is swung upwardly, hinge pin 29 on bending member 16 moves along slots 24 and is guided in a fashion such that the contacting portion maintains substantially the same relative position of contact thereby minimizing marring of the surface of sheet material. To the extent thus far described, the bending brake of FIGS. 11 and 12 is essentially the same as that disclosed in above-referenced U.S. Ser. No. 08/375,080, to which reference is made for a more detailed description. It will be appreciated, of course, as the present discussion unfolds, that the present invention is by no means limited to bending brakes of this construction. Rather, the bending brake of FIGS. 11 and 12 is illustrated as an exemplary, albiet preferred, implication of the invention.

Figure 1:
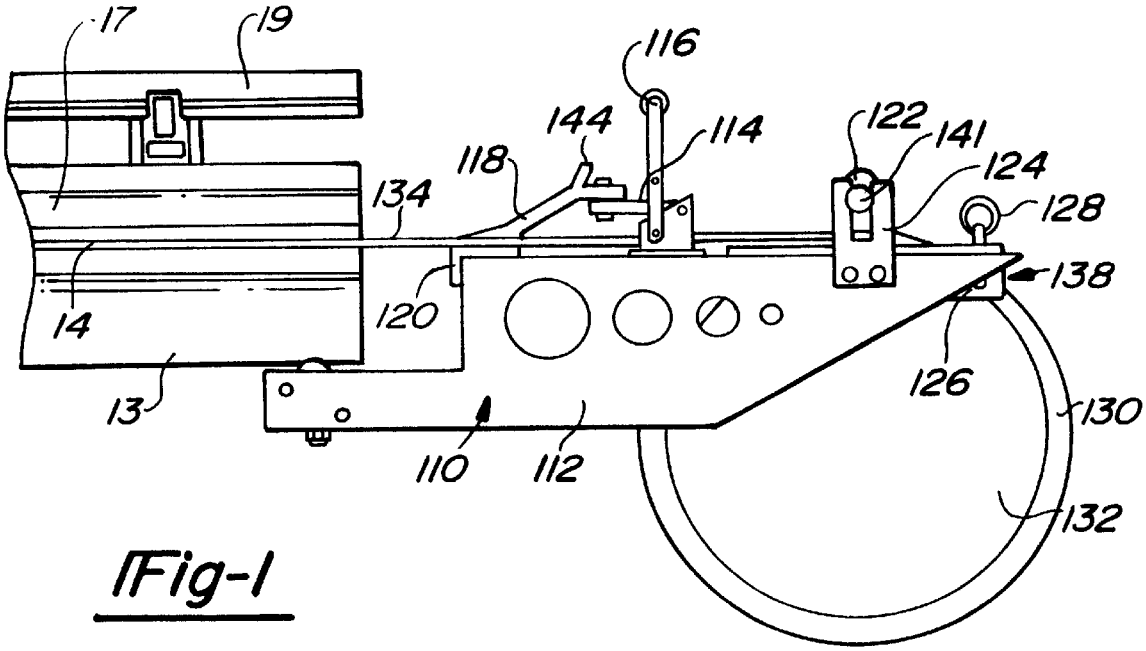
FIG. 1 is a fragmentary side elevational view of a combined portable sheet bending brake and a coil support embodying the invention.
Figure 2:
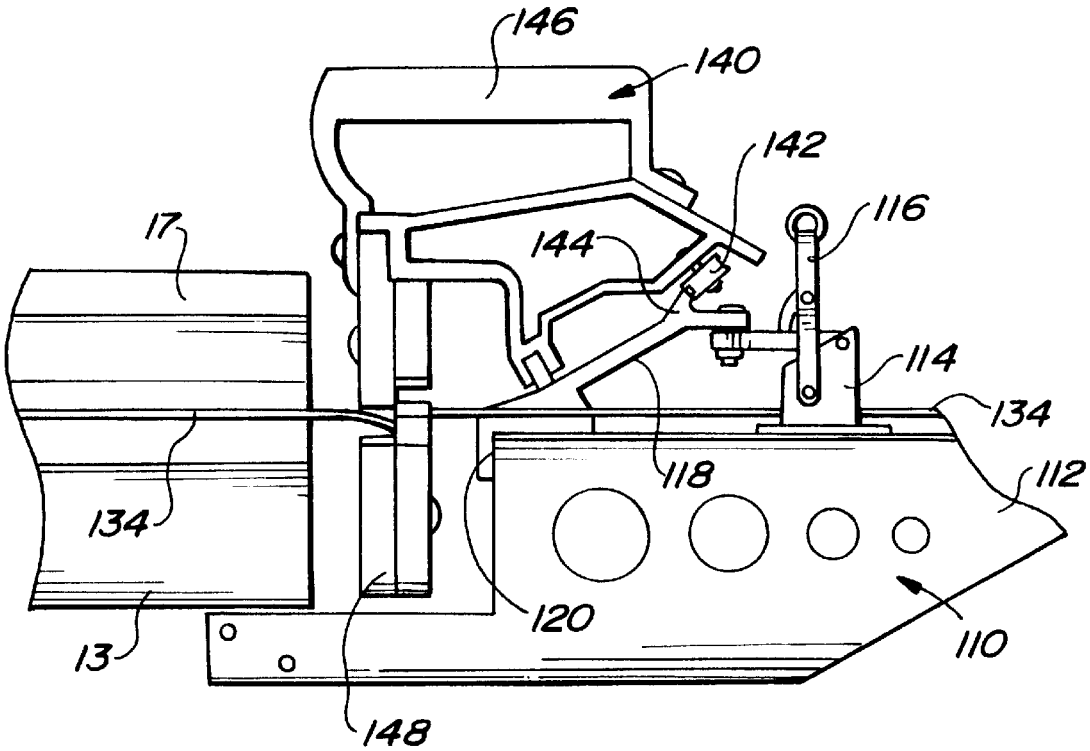
FIG. 2 is an enlarged fragmentary side elevational view showing a hand-operated cutter in position on the coil support for severing material from the coil.

Referring to FIGS. 1 and 2, a coil dispenser 110 is mounted on one end of the portable sheet bending brake. Dispenser 110 has side panels 112, 112A (FIGS. 6 and 7) which carry a pair of traverse plates 126, 127 of a trolley assembly 138. Trolley assembly 138 is locked in place by means of a pin 128 (FIG. 1) that extends through plate 126 into side panel 112. A coil 130 of sheet stock material has a central opening 132 allowing free access by the trolley assembly 138. The sheet run-off or free end 134 of coil 130 is extended through and between the opposed surfaces of a movable clamp 118 and a fixed clamping bar 120 carried by panels 112, 112A, and is held in clamped position by moving a clamp assembly 114 with a handle 116 to an upright position. A pinch roller 122 has spaced ends 141 that are carried by spaced control forks 124 on panels 112, 112A to prevent coil backlash. Sheet run-off 134 extends into the portable sheet bending brake along fixed clamping member 13—i.e., between fixed clamping member 13 and movable clamping member 17.

As seen in FIG. 2, coil dispenser 110 has the sheet run-off 134 extending past the clamp assembly 114 and onto the fixed clamping member 13. The sheet run-off 134 is severed by extending a removable portable cutter 140, having a roller guide 142 that rides along a rail track 144 of clamp 118, along rail track 144 using the hand grip 146. A slot in the cutter die assembly 148 receives the sheet run-off prior to the severance. The removable portable cutter 140 is more fully disclosed and described in copending application Ser. No. 08/373,080 filed Jan. 17, 1995, now U.S. Pat. No. 5,582,053, incorporated herein by reference.

Figure 3:
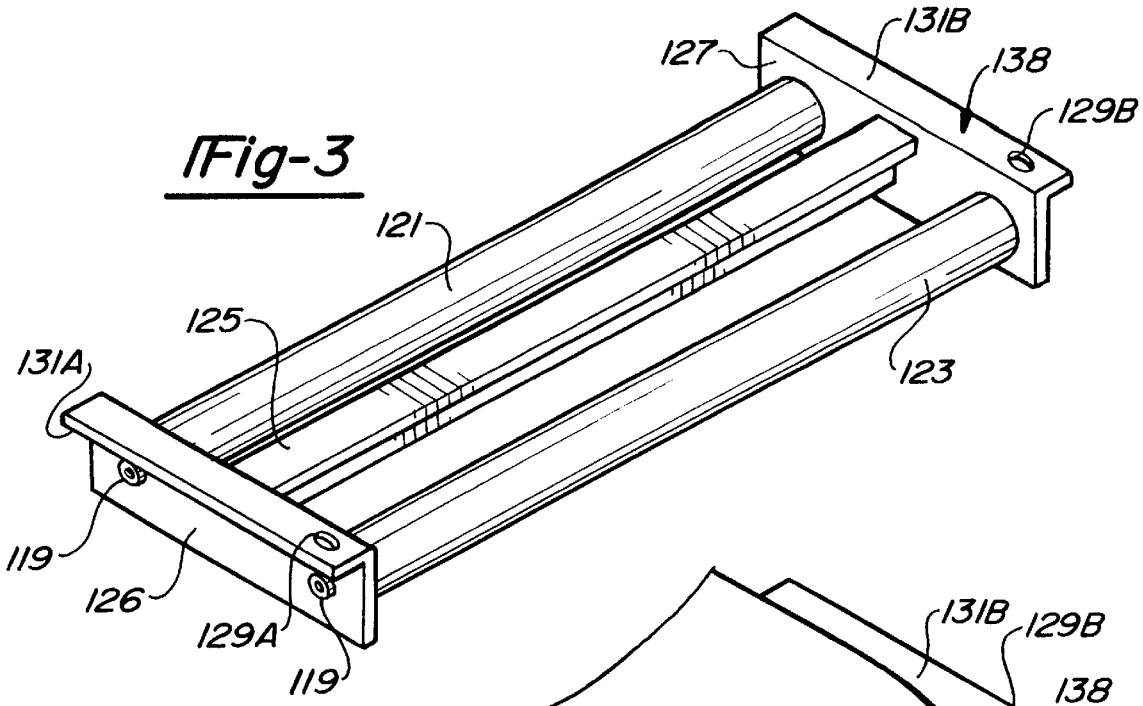
FIG. 3 is a perspective view of the coil trolley.
Figure 4:
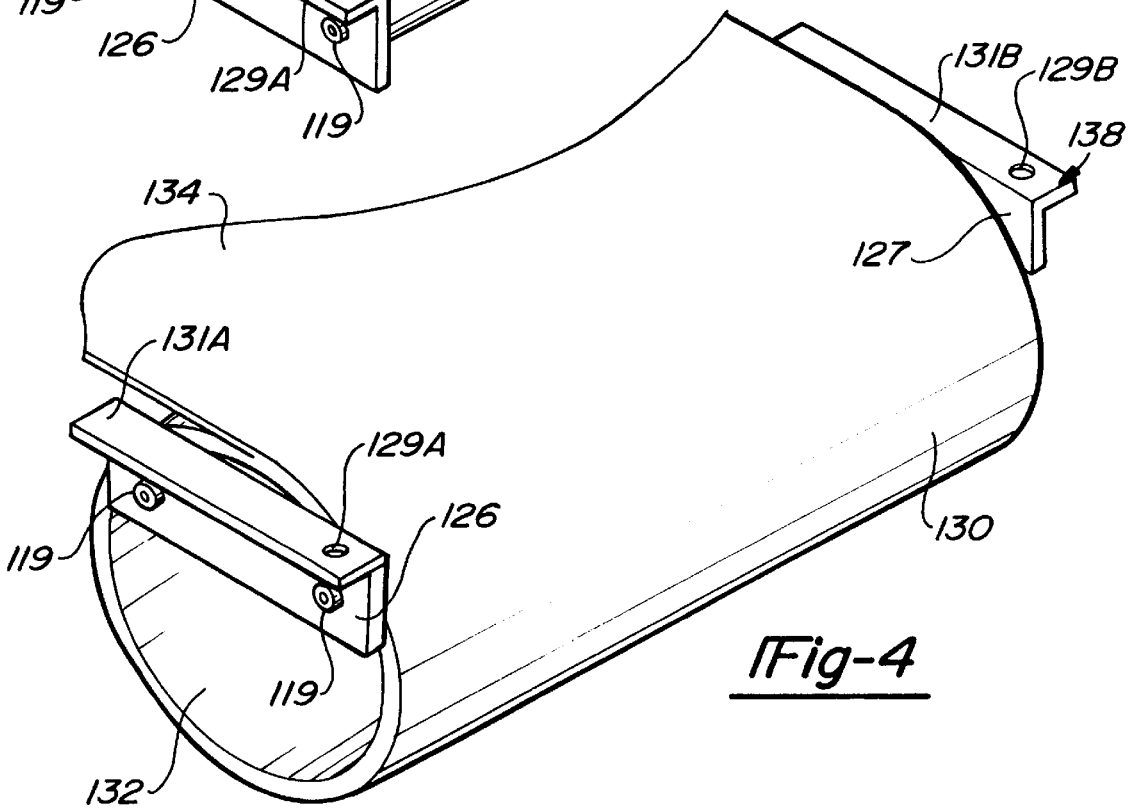
FIG. 4 is a fragmentary perspective view of a coil of sheet material in rotational position on the trolley.
Figure 5:
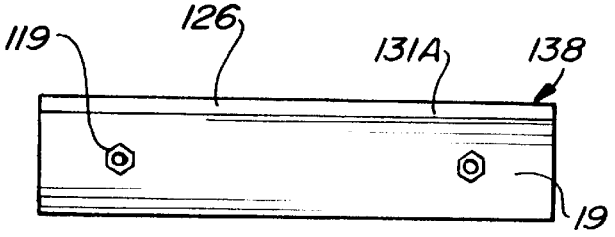
FIG. 5 is a side elevational view of a trolley roller end support.

Referring to FIGS. 3–5, trolley assembly 138 comprises a first axle plate 126 and a second axle plate 127 mounted to and interconnected by a fixed center cross-member 125. A pair of parallel rollers 121, 123 are mounted on opposed sides of cross-member 125 and fixed to axle plates 126 and 127 by axle nuts 119. Extending outward from axle plates 126 and 127 are coplanar support ledges 131A and 131B each having an associated hitch pin access opening 129A and 129B. Trolley assembly 138 is insertable through center opening 132 in coil 130, with coil 130 being supported by and freely rotatable on rollers 121, 123. Axle plates 126 and 127 extend along the ends of the coil 130, allowing sheet run-off 134 to roll from the coil 130.

Figure 6:
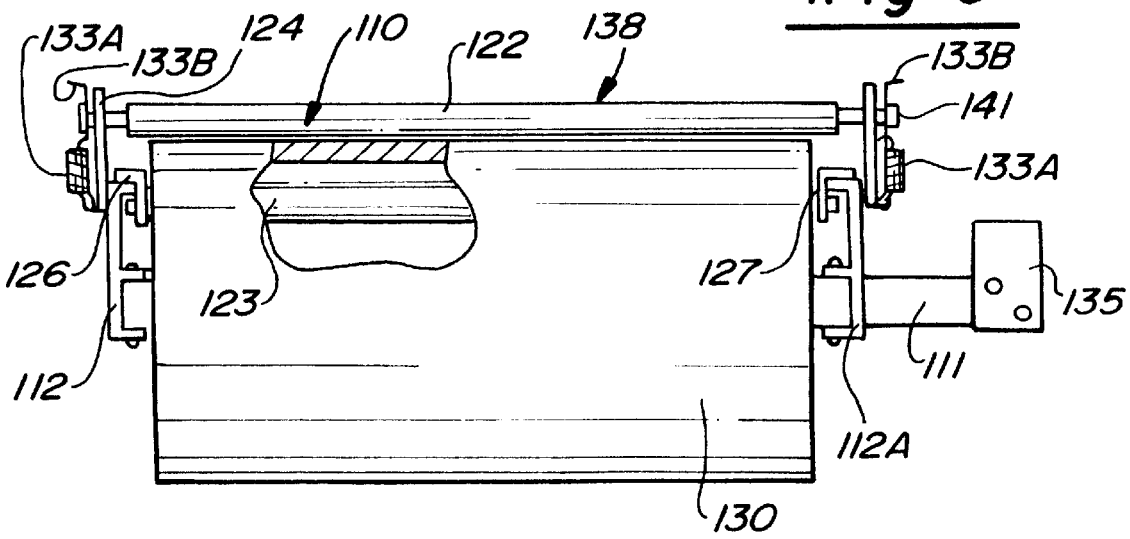
FIG. 6 is a part-sectional rear elevational view of a coil in communication on the trolley rollers and a pinch roller.
Figure 7:
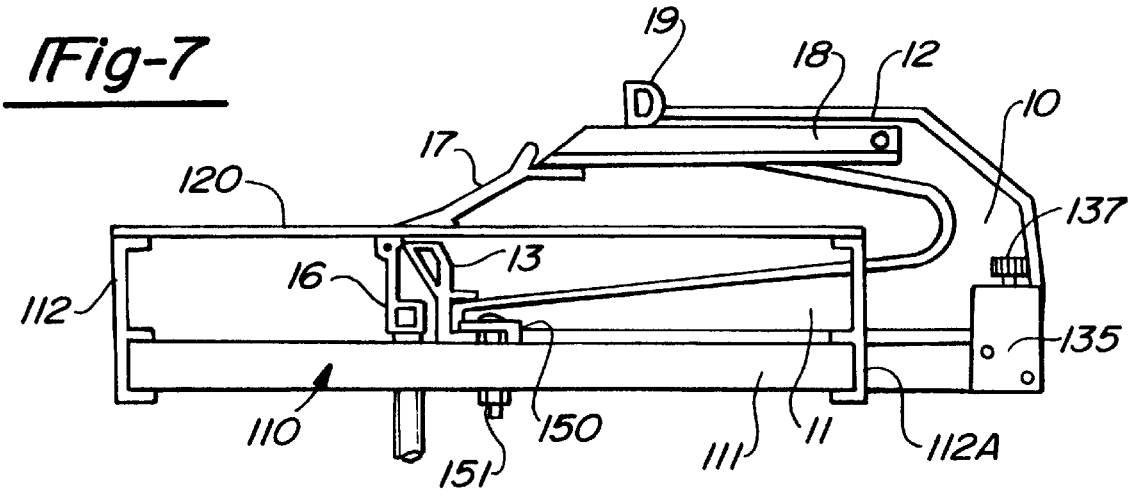
FIG. 7 is a rear elevation of the skeletal frame and mounting means of the preferred embodiment as adapted to a sheet bending brake.
Figure 8:
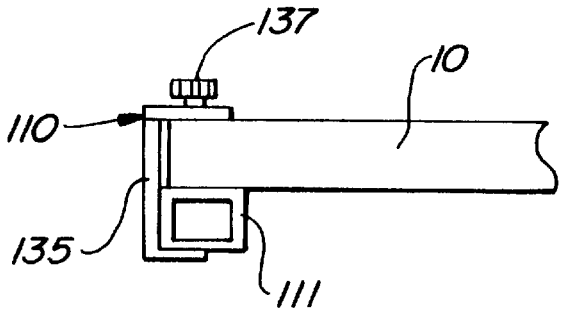
FIG. 8 is a fragmentary side elevational view of the mounting means in FIG. 7.

Referring now to FIGS. 6–8, coil dispenser 110 comprises a main frame rail 111 connected to side panels 112 and 112A, which are adapted to support axle plates 126 and 127 of the trolley assembly 138. Coil stock 130 is pinched between rollers 121, 123 and roller 122 by extending a retaining clip 133B, having a spring 133A, over the axle end 141 of roller 122 that extends past control fork 124. Located along and fastened to frame rail 111 is a mounting plate 135. Coil dispenser 110 is mounted on the sheet bending brake by means of mounting plate 135 and a tension fastener 137 engaging the end of rail 15 (FIG. 11), and a mounting block 150 having tension fastener 151 located by side panels 112 and 112A on the end of fixed clamping bar 13. Tension fastener 137 is freely manually rotatable for adjusting the level of frame rail 111 relative to the sheet bending brake. This level is adjusted such that the upper clamping surface of bar 120 is coplanar with surface 14 of member 13, as been seen in FIG. 1. Sheet end stock 134 is thus freely slidable along bar 120 and surface 14 when clamping bar 118 is released.

Figure 9:
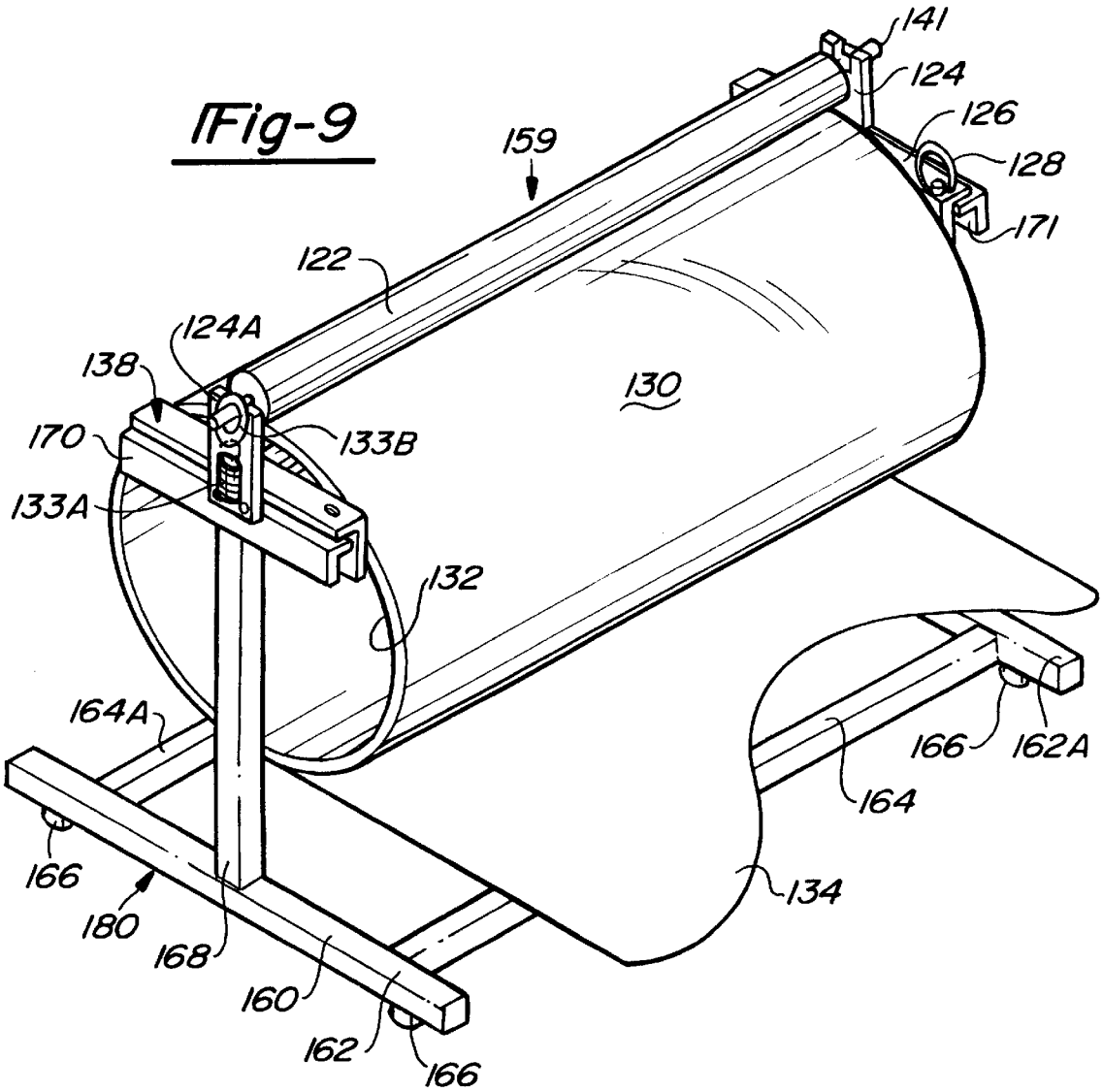
FIG. 9 is a fragmentary perspective view of another embodiment of the present invention depicting a base stand for use with the coil laden trolley.
Figure 10:
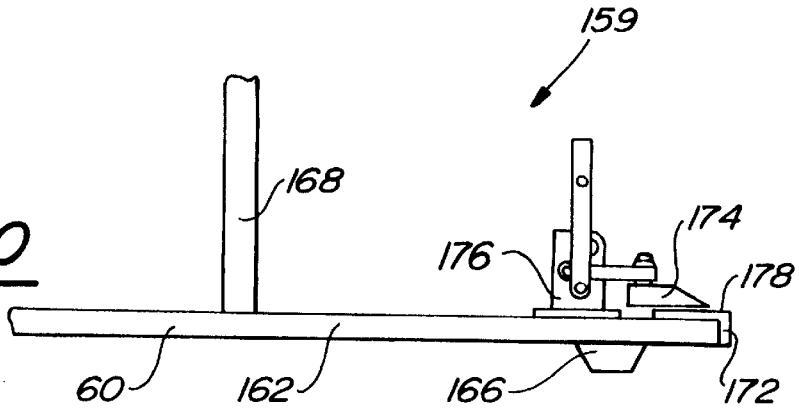
FIG. 10 is a fragmentary side elevation of the base in FIG. 9 further depicting a fixed bar member clamp in relation to a movable scoring bar clamp operable by means of a locking clamp.

FIGS. 9-10 illustrate another dispenser 159 in accordance with the invention as comprising a base 160 for dispensing coil 130 from an independent location. Trolley assembly 138 is inserted through central opening 132 of coil 130, and rests upon supports 170 and 171 of a rigid stand 180. A hitch pin 128 is inserted through an opening in each axle plate 126, 127 restricting the movement of the trolley assembly 138. Pinch roller 122 is inserted between control forks 124 and 124A. Retainer springs 133A are attached to clips 133B, which is fitted over the ends of axle 141 to bias pinch roller 122 onto stock coil 130 preventing coil unraveling. Frame 180 is spaced parallel base rails 162, 162A interconnected by spaced parallel cross-members 164, and 164A. Located at the corners of the base rails 162, 162A are support bumpers or feet 166. Extending upward from base rails 162, 162A are spaced parallel trolley support masts 168, which provide the fixed elevation of sheet material run-off 134. Mounted to and extending between the top surfaces of base rails 162, 162A are a fixed clamping bar 172 (FIG. 10) and a movable clamping bar 174 attached to a hand clamp assembly 176. Located along the outer face of the clamping bar is a scoring edge 178 used as a guide for a utility knife (not shown).

It can be seen that there has been provided a combined sheet bending brake, coil support and cutter, and a method of use, which permit the leading edge of the workpiece to pass directly from the coil between the clamping member and the fixed member of the sheet bending brake; which provide a portable bending brake coil support and hand-operated cutter system that is removably mounted on the coil support; which will accurately cut the workpiece to a desired length; which require minimal modification of the sheet bending brake; which can be readily added to an existing sheet bending brake; which will provide accurate, smooth and flat edges on the workpiece; which cut the workpiece quickly and are therefore time-saving; which do not damage the aluminum parts of the sheet bending brake; and which are low in cost; wherein the coil support has a detachable trolley member for insertion through the coil opening thereby facilitating the elevation of the coil to the bending break; wherein the detachable trolley member with a separate base member allows the rotational dispensation of the coil stock from any flat surface; wherein the support coil apparatus has a movable clamping track portion for allowing unobstructed passage of the coil stock material through and into the sheet bending brake to a predetermined point where a clamping track is closed to clamp the coil such that subsequently a hand operated cutter are extended along a track on the clamp to sever from the coil.

We claim:

1. A dispenser for sheet stock in the form of a coil having a central therethrough-opening, said dispenser comprising:

a support frame having a spaced pair of trolley support surfaces, trolley means releasably mounted between said trolley support surfaces, said trolley means including a trolley frame and a pair of spaced trolley rollers carried by said trolley frame, said trolley rollers and said trolley frame being of a size so as to be removably received within said coil through-opening such that the stock coil is freely rotatably suspended by said trolley rollers when said trolley frame is mounted between said trolley fuel support surfaces, and means carried by said support frame for clamping a stock end extending from a coil on said trolley means, including a fixed clamp bar extending across said support frame transverse to the stock end, a movable clamp bar, and means carried by said support frame and coupled to said movable clamp bar for clamping stock from the coil against said fixed clamp bar.

2. The dispenser set forth in claim 1 wherein said means coupled to said clamp bar includes means for locking said movable clamp bar in position clamping stock from a coil on said trolley means against said fixed clamp bar.

3. The dispenser set forth in claim 2 wherein said movable clamp bar includes means for guiding means for cutting sheet stock clamped between said fixed and movable clamp bars.

4. The dispenser set forth in claim 3 wherein said guiding means includes a rail for supporting a roller of a manual cutter.

5. The dispenser set forth in claim 3 wherein said guiding means includes an edge for guiding a scoring tool along sheet stock clamped between said bars.

6. The dispenser set forth in claim 1 further comprising a pinch roller rotatably supported on said support frame for engaging a coil carried by said trolley means on said support frame and preventing backlash of stock in the coil.

7. The dispenser set forth in claim 6 further comprising means on said support frame for removably receiving said pinch roller, such that said pinch roller may be removed from said support frame for mounting and dismounting said trolley means and a coil carried thereby on said support frame.

8. The dispenser set forth in claim 7 further comprising means for resiliently urging said pinch roller against a stock coil carried by said trolley means on said support frame.

9. The dispenser set forth in claim 1 wherein said support frame includes a base with feet for supporting said support frame on a work surface.

10. The dispenser set forth in claim 1 wherein said support frame includes means for removably mounting said support frame on an end of a sheet bending brake having elongated fixed and movable clamping members in such a way that sheet stock extending from a coil carried by said trolley means on said support frame extends longitudinally between said fixed and movable clamping members on the bending brake.

* * * * *